United States Patent [19]

Schaaf

[11] Patent Number: 5,023,512

[45] Date of Patent: Jun. 11, 1991

[54] GETTER MEANS AND LAMP INCLUDING SAME

[75] Inventor: Walter A. L. Schaaf, Diest, Belgium

[73] Assignee: GTE Sylvania N.V., Tienen, Belgium

[21] Appl. No.: 414,891

[22] Filed: Sep. 29, 1989

[30] Foreign Application Priority Data

Sep. 30, 1988 [EP] European Pat. Off. ..... 88202147.0

[51] Int. Cl.[5] ..... H01J 17/24; H01J 19/70; H01J 61/26

[52] U.S. Cl. ..... 313/560; 313/545; 313/546; 313/558; 313/559; 313/560

[58] Field of Search ..... 313/545, 546, 558, 559, 313/560, 561, 562

[56] References Cited

U.S. PATENT DOCUMENTS

| | | | |
|---|---|---|---|
| 3,519,864 | 7/1970 | Gungle et al. | 313/560 X |
| 4,004,171 | 1/1977 | Heuvelmans | 313/15 |
| 4,891,542 | 1/1990 | Mellor et al. | 313/560 X |

FOREIGN PATENT DOCUMENTS 6411552 11/1965 Netherlands .

OTHER PUBLICATIONS

Patent Abstracts of Japan, vol. 3, No. 12, Appln. No. 53-47909, Kokai No. 53-135187, 11/78.

*Primary Examiner*—Sandra L. O'Shea
*Assistant Examiner*—Brian Zimmerman
*Attorney, Agent, or Firm*—Martha Ann Finnegan

[57] ABSTRACT

A lamp including an evacuated outer jacket, a light source capsule mounted within an evacuated outer jacket, and getter assembly disposed within the outer jacket is disclosed. the getter assembly includes a getter and protection device for protecting lamp parts, e.g., the inner surface of the outer jacket, during flashing of the getter. In a most preferred embodiment, the protection device is formed by a small glass envelope, preferably similar to a photoflash bulb envelope, having a small opening. A getter, such as a getter ring, typically used in the lighting art, is mouted within the bulb envelope. When the getter is activated, the metal vapor of the activated getter is caught inside this bulb envelope and condenses on the inside glass surface of the latter. the impurities within the outer jacket of the lamp diffuse through the opening in the bulb envelope of the protection device of the preferred embodiment and are absorbed by the getter. Getter assembly for use in lamp having an evacuated outer jacket, the getter assembly including a getter and a fully closed envelope surrounding the getter is also disclosed.

24 Claims, 1 Drawing Sheet

GETTER MEANS AND LAMP INCLUDING SAME

TECHNICAL FIELD OF THE INVENTION

This invention relates to getter means and lamps including getter means.

BACKGROUND OF THE INVENTION

High vacuum lamps typically include a light source capsule, such as an arc tube, mounted within an evacuated outer envelope.

Generally, in order to improve the vacuum within the outer envelope, high vacuum lamps, e.g., high intensity discharge lamps, including metal vapor lamps, such as sodium lamps and metal halide lamps, are provided with getter means comprising one or more U-shaped getter rings filled with a fast acting getter, for example, barium-aluminum. The getter rings are normally installed in the lower end of the lamp. To activate the getter, a high frequency induced heating is applied to the metal getter rings by means of a coil slid over the lamp. Activating the getter results in the flashing of the latter.

The metal vapors that evaporate during flashing condense on the glass wall and on other parts of the lamp. During condensing, impurities are absorbed by the getter.

As a result of the condensed metal vapors, the bulb wall is contaminated and the glass surface is made opaque. Furthermore, the flashing causes a darkening near the base of the bulb.

Quite obviously, the prior art lamps described above show the disadvantage that the condensed metal can affect the light intensity of the lamp and also contaminate the lamp parts in the bulb.

A greater disadvantage still, consists in the fact that, due to said darkening, the cosmetic appearance of the lamp is significantly reduced, said darkening causing the idea that, even new, the lamps have already been used before.

It would represent an advance in the art to overcome the above-stated disadvantages.

SUMMARY OF THE INVENTION

In accordance with one aspect of the present invention, there is provided a lamp comprising a light source capsule mounted within an evacuated outer envelope and getter means disposed within the outer envelope, the getter means including a getter and protection means for protecting lamp parts during flashing of the getter.

In its most preferred embodiment the protection means are formed by a small glass envelope, preferably similar to a photoflash bulb envelope, having a small opening. A getter, such as a typical getter ring, is mounted within the bulb envelope. When the getter is activated, the metal vapor of the activated getter is caught inside this bulb envelope, and will condense on the inside glass surface of the latter. The impurities within the outer envelope of the lamp diffuse through the opening in the bulb envelope of the protection means of the preferred embodiment and are absorbed by the getter.

In accordance with another aspect of the present invention there is provided getter means comprising a getter and a fully closed envelope surrounding the getter, the envelope being adapted to provide a small opening.

The use of getter means comprising protection means in the form of a small bulb envelope, e.g., of photoflash type, presents the advantage that, during the manufacturing of these bulbs, after dropping the getter ring into the bulb, the latter can, if desired, be put under vacuum to evacuate the impurities and can be tipped off. In this way the getter means can be stored for a long time before placing them into a high vacuum lamp, without contamination of the getter.

Before mounting the getter means into a vacuum lamp, the tip of the getter bulb is opened.

With the above and other objects in view, which will become apparent from the detailed description below, the invention is illustrated in the accompanying drawings by way of example only.

DETAILED DESCRIPTION

The present invention relates to an improved lamp comprising a light source capsule mounted within an evacuated outer envelope and getter means disposed within the evacuated outer envelope, the getter means including a getter and protection means for protecting lamp parts during flashing of the getter.

In its most preferred embodiment the protection means are formed by a small glass envelope, preferably similar to a photoflash bulb envelope, having a small opening. A getter, such as a typical getter ring is mounted within the bulb envelope. When the getter is activated, the metal vapor of the activated getter is caught inside this bulb envelope, and will condense on the inside glass surface of the latter. The impurities within the outer envelope of the high vacuum lamp diffuse through the oPening in the bulb envelope of the protection means of the preferred embodiment and are absorbed by the getter.

The use of getter means comprising a getter and protection means in the form of a small bulb, e.g., of photoflash type, presents the advantage that, during the manufacturing of these bulbs, after dropping the getter ring into the bulb, the latter can be put under vacuum to evacuate the impurities and can be tipped off. In this way the getter means can be stored for a long time before placing them into a high vacuum lamp, without contamination of the getter.

Before mounting the getter means into a vacuum lamp, the tip of the getter bulb is opened.

An improved lamp according to the invention may further include a coating on the inner surface of the outer envelope, which will not be contaminated by the flashing of the getter.

The present invention can be better appreciated and understood with reference to the drawings.

Figure 1:
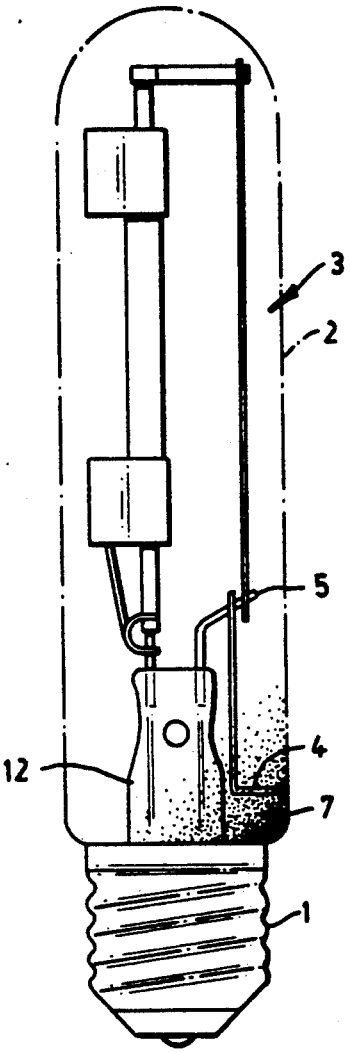
PRIOR ART FIG. 1
FIG. 1 represents a prior art lamp.

Referring to FIG. 1, there is illustrated a prior art high vacuum sodium lamp, comprising a socket 1, a bulb 2, and the interior lamp parts 3, the latter including at least one metal getter ring 4.

The getter ring 4 is normally mounted in the lower end of the sodium lamp by means of a support welded to a lead wire 5.

Figure 2:
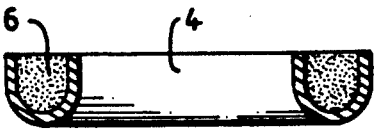
PRIOR ART FIG. 2
FIG. 2 represents a large scale cross section drawing of a classical getter ring.

As represented in FIG. 2 the getter ring 4 has normally a U-shaped cross section. A barium-aluminum getter 6 is incorporated in the U-channel of the ring 4.

To activate the getter 6, a high frequency heating of the ring 4 is applied, resulting in the flashing of the getter. As explained above, the metal vapors condense on the glass wall of the bulb 2 and make the glass surface oPaque. Moreover, there is a darkening 7 of the glass near the getter ring 4.

Figure 3:
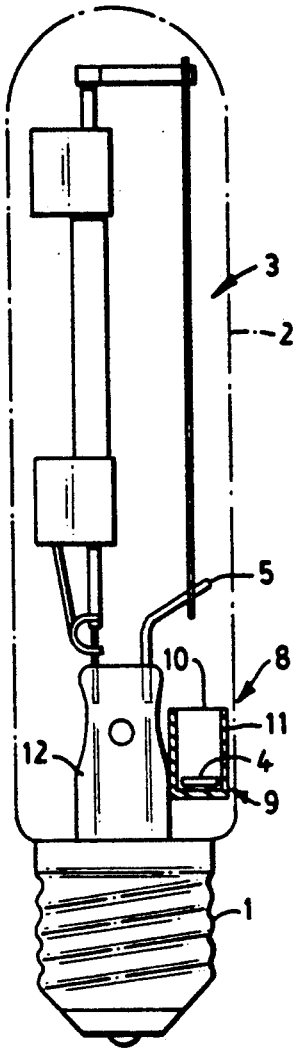
FIG. 3 represents a lamp according to the present invention.
Figure 4:
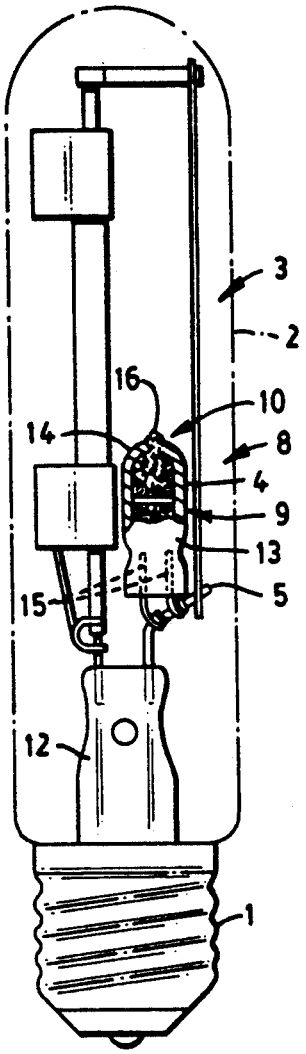
FIG. 4 represents a preferred embodiment of the invention.

FIGS. 3 and 4 show sodium lamps according to the present invention. To overcome the contamination inside the bulb 2, these lamps comprise getter means 8, which comprise a getter and means protecting the lamp parts, i.e., parts 3, and the inside glass surface of the bulb 2, during flashing of the getter 6.

Preferably these protection means comprise a glass envelope 9 having an opening 10 which is small enough to trap the getter inside the envelope.

In the embodiment of FIG. 3, the envelope 9 has the form of a cup 11. The getter means 8 further comprise a getter ring 4 which is placed at the bottom of the cup 11. The cup 11 can be fixed to the central support 12.

Only very small contact areas between the getter ring 4 and the glass envelope 9 can be tolerated; otherwise, during high frequency heating of the ring 4, the latter will heat the glass wall of the envelope 9, causing cracking of the wall, which finally may result in deterioration of the getter or in the fact that glass particles or other portions become loose in the lamp. Preferably, the getter ring 4 is isolated with respect to the glass envelope 9.

When the getter 6 is activated, at least the flashing effect will not darken the bulb wall 2 of the lamp.

In order to minimize the contamination inside the bulb 2, the envelope 9 preferably is in the form of a bottle having a very small opening 10. As shown in FIG. 4, this is obtained by using a small photoflash bulb 13, e.g., of the FC-4 type.

In manufacturing, before closing the bulb 13, a getter ring is dropped into this bulb. Some fine shredded foil 14, e.g., zirconium foil, is added into the bulb to increase the contact surface for the getter and to line up the getter ring 4.

The small bulb 13 is fixed inside the lamp by welding the lead wires 15 to one of the lead wires 5 of the lamp. The getter ring 8 can be placed perpendicularly or in line with the axis of the bulb 13, whilst the bulb 13 can be mounted in any direction into the bulb 2 of the lamp. Of course, the getter ring 4 has to be in a position that it can be activated by the high frequency induced heating.

After the lamp is put under vacuum by well-known classical means and is sealed off, the vacuum inside the lamp will be imProved by activating the getter 6 inside the small bulb 13. The getter vapor will condense on the zirconium foil 14 and on the inside glass surface of the bulb 13. The impurities still present in the lamp diffuse through the opening 10 and are absorbed by the getter 6.

The getter means 8 of FIG. 4 was tested with 35 Watt and 70 Watt sodium arc tubes and were mounted in white coated tabular bulbs. The cosmetic appearance of the tubes was greatly improved with the new getter means 8; whereas with the classical getter means, there was a darkening near the base of the bulb. The bulb with the preferred getter means 8 was entirely white.

The use of an envelope 9 in the form of a bulb 13, especially of the photoflash type, offers the advantage that the envelope 9 can be put under vacuum to evacuate the impurities and can be tipped off. In this way at the getter means 8 can be stored for a long time before being placed in a high vacuum lamp, without contamination of the getter 6. Afterwards, before doing the outer jacketing of the sodium lamp, the envelope 9 of the getter bulb 13 is opened, e.g., by breaking off the tip 16. Hereafter, the bulb 13 containing the getter ring 4 is placed inside the lamp as explained before.

The getter means 8 can be used in all sodium lamps or other high vacuum lamps, e.g., metal halide, cadmium, thallium and indium lamps. Such lamps are well-known in the art. Different sizes and forms of getter rings 4 and bulbs 13 can be used to modify speed or getter capacity.

Instead of shredded foil 14, also other means to increase the contact surface for the getter 6 can be used.

The present invention is not limited to the embodiments described, which should be considered as exemplary only. Devices constructed in accordance with this invention can be made with various shapes and dimensions in a manner known to those skilled in the art, without departing from the spirit and the scope of the present invention.

I claim:

1. A lamp comprising an evacuated outer envelope, a light source capsule mounted within the evacuated outer envelope, and getter means disposed within the evacuated outer envelope, the getter means including a getter and protection means for protecting lamp parts during flashing of the getter, the protection means comprising an envelope having an opening, the getter being disposed within the envelope.

2. A lamp in accordance with claim 1 wherein the envelope is formed by a glass cup having a small opening.

3. A lamp in accordance with claim 1 wherein the envelope is formed by a glass bulb having a small opening.

4. A lamp in accordance with claim 3 wherein the glass bulb is of the photoflash type.

5. A lamp in accordance with claim 3 wherein the glass bulb is provided with lead wires extending out of the bulb, wherein, in order to fix the bulb inside the lamp, the lead wires extending out the bulb are welded to a lead wire of the lamp.

6. A lamp in accordance with claim 3 wherein the glass bulb is a bulb of the photoflash type, the tip of which is broken off in order to form the opening.

7. A lamp in accordance with claim 6 wherein the getter is in the form of a getter ring, the getter ring being disposed within the bulb of the protection means.

8. A lamp in accordance with claim 1 wherein the getter is in the form of a getter ring, the getter ring being disposed within the envelope of the protection means.

9. A lamp in accordance with claim 8 wherein the getter ring is placed perpendicularly relative to the axis of the envelope.

10. A lamp in accordance with claim 7 wherein the getter ring is placed perpendicularly relative to the axis of the bulb.

11. A lamp in accordance with claim 10 wherein the envelope further includes shredded foil which is used to line up the getter ring in the envelope.

12. A lamp in accordance with claim 11 wherein the getter consists essentially of barium-aluminum.

13. A lamp in accordance with claim 1 wherein the getter means further comprises means to increase the contact surface of the getter.

14. A lamp in accordance with claim 13 wherein the means to increase the contact surface of the getter comprises shredded foil.

15. A lamp in accordance with claim 13 wherein the shredded foil comprises zirconium foil.

16. A lamp in accordance with claim 15 wherein the lamp is a sodium lamp.

17. A lamp in accordance with claim 15 wherein the lamp is a metal halide lamp.

18. Nonreactive getter means for use in a lamp having an evacuated outer jacket, the nonreactive getter means comprising a getter and a fully closed envelope surrounding the getter, the getter means being capable of becoming reactive upon opening of the envelope.

19. Nonreactive getter means in accordance with claim 18 wherein the getter means further comprises shredded zirconium foil, and the getter comprises a getter ring, and the foil and getter ring are disposed within the envelope.

20. Nonreactive getter means in accordance with claim 18 wherein the envelope is under vacuum.

21. Nonreactive getter means in accordance with claim 18 wherein the envelope is provided with wires extending out of the envelope for mounting the getter means into lamps.

22. Nonreactive getter means in accordance with claim 18 wherein the envelope comprises a glass bulb of a photoflash type having a tip which can be broken off in order to form an opening.

23. Nonreactive getter means in accordance with claim 22 wherein the getter means further comprises shredded zirconium foil, and the getter comprises a getter ring, and the foil and getter ring are disposed within the bulb.

24. Nonreactive getter means in accordance with claim 23 wherein the bulb is under vacuum.

* * * * *